US005460696A

United States Patent [19]

Kirschner et al.

[11] Patent Number: 5,460,696

[45] Date of Patent: Oct. 24, 1995

[54] OXYGEN DELIGNIFICATION METHOD INCORPORATING WOOD PULP MIXING APPARATUS

[75] Inventors: Mark J. Kirschner, Morristown; Rustam H. Sethna, New Brunswick, both of N.J.

[73] Assignee: The BOC Group, Inc., New Providence, N.J.

[21] Appl. No.: 105,248

[22] Filed: Aug. 12, 1993

[51] Int. Cl.[6] ..... D21C 9/147

[52] U.S. Cl. ..... 162/40; 162/52; 162/57; 162/65

[58] Field of Search ..... 162/65, 57, 52, 162/19, 243, 237, 29, 37, 40

[56] References Cited

U.S. PATENT DOCUMENTS

| | | | |
|---|---|---|---|
| 3,843,473 | 10/1974 | Samuelson et al. | 162/65 |
| 3,951,733 | 4/1976 | Phillips | 162/65 |
| 3,963,561 | 6/1976 | Richter | 162/17 |
| 4,089,737 | 5/1978 | Nagano et al. | 162/19 |
| 4,161,421 | 7/1979 | Sherman | 162/18 |
| 4,259,147 | 3/1981 | Gordy | 162/12 |
| 4,259,150 | 3/1981 | Prough | 162/65 |
| 4,274,913 | 6/1981 | Kikuiri et al. | 162/65 |
| 4,363,697 | 12/1982 | Markham et al. | 162/19 |
| 4,384,920 | 5/1983 | Markham et al. | 162/19 |
| 4,406,735 | 9/1983 | Samuelson | 162/40 |
| 4,431,480 | 2/1984 | Markham et al. | 162/19 |
| 4,581,104 | 4/1986 | Luthi | 162/43 |
| 5,034,095 | 7/1991 | Kido et al. | 162/17 |

FOREIGN PATENT DOCUMENTS

| | | | |
|---|---|---|---|
| 1065105 | 10/1984 | Canada | 162/65 |
| 2710700 | 3/1976 | Germany | 162/65 |

*Primary Examiner*—Steve Alvo

*Attorney, Agent, or Firm*—David M. Rosenblum; Larry R. Cassett

[57] ABSTRACT

An oxygen delignification method and apparatus in which a charge of heated wood pulp is reacted with oxygen in the presence of a charge of caustic soda in a plurality of reaction stages located between mixing stages in which caustic is mixed with the wood pulp. The use of the plurality of mixing stages reduces peak pH exposure of the wood pulp that would otherwise occur if the charges of caustic and wood pulp were mixed all at once. Moreover, the caustic mixed in such manner replenishes neutralized caustic and ensures that the average pH level is increased above that in conventional oxygen delignification. The increase in average pH level favors an increase in the delignification. Filtrate from a washing stage is introduced into the mixing stages to prevent wood pulp degradation. Oxygen is mixed within the wood pulp by a wood pulp mixer that employs coaxial perforate passageways between which the wood pulp is retained and driven but which allow the oxygen to pass in an inward radial direction of the passageways to mix with the wood pulp.

5 Claims, 3 Drawing Sheets

OXYGEN DELIGNIFICATION METHOD INCORPORATING WOOD PULP MIXING APPARATUS

BACKGROUND OF THE INVENTION

The present invention relates to an oxygen delignification method and apparatus in which wood pulp and oxygen are reacted in the presence of caustic soda such that the caustic soda is mixed with the wood pulp in a plurality of mixing stages, the wood pulp is reacted with the oxygen in a plurality of reaction stages located between the mixing stages and filtrate, produced from a washing stage, is mixed with the wood pulp in the mixing stages along with the caustic soda. In another aspect, the present invention relates to a wood pulp mixer having coaxial external, intermediate and internal passageways. The intermediate and internal passageways are provided with perforations sized to retain the wood pulp such that a gas circulated through the external, intermediate and internal passageways mixes with the wood pulp while the wood pulp is driven between the intermediate and internal passageways.

In the production of paper, wood chips are treated with cooking liquor to form wood pulp. In order to produce an unpigmented wood pulp, lignins from the pulp are removed in a process known as oxygen delignification. Subsequent bleaching stages are used to further remove pigments from the wood pulp. Oxygen delignification is carried out by mixing steam with the wood pulp. Thereafter, caustic soda derived from oxidized white liquor is mixed with the wood pulp. The heated wood pulp is then reacted with the oxygen and in the presence of the caustic soda. These foregoing operations allow the lignin to be dissolved from the pulp fiber by a solvent (normally water) in a subsequent washing stage.

After treatment with oxygen, the wood pulp is introduced into the bottom of a treatment tower in which the wood pulp is vertically driven and removed from the top. Passage of the wood pulp through this tower takes approximately one hour. After removal from the tower, the wood pulp, as mentioned above, is washed to produce a filtrate. The filtrate, is often mixed with weak black liquor being discharged from the initial treatment of the wood chips.

The rate of delignification is dependent upon the pH during reaction of the wood pulp and the oxygen. The higher the pig the greater the degree of delignification. This is not without limit in that a point is reached at which the cellulose is attacked by the caustic soda to cause degradation of the wood pulp. In practice, a charge of wood pulp is mixed with a charge of caustic soda. The wood pulp is then reacted with the oxygen and during such reaction, the caustic soda is being neutralized with acidic reaction by-products to lower the pH during the reaction. Therefore, the rate of delignification decreases during the reaction due to the neutralization of the caustic soda during the reaction. The degree of delignification cannot, however, be increased by supplying a greater initial charge of the caustic soda because of possible pulp degradation and therefore, the delignification of any charge of wood pulp is limited by initial peak pit exposure of the wood pulp to the caustic soda.

As will be discussed the present invention provides an oxygen delignification method in which a greater amount of delignification for a given charge of wood pulp is possible as compared with prior art oxygen delignification methods. Additionally, the present invention provides an apparatus for conducting oxygen delignification that effects a simplification over prior art methodology and apparatus.

SUMMARY OF THE INVENTION

In accordance with the method of the present invention a charge of wood pulp is heated and then reacted with oxygen of an oxygen-containing gas. A charge of caustic soda is mixed with the charge of wood pulp such that the charge of wood pulp reacts with the oxygen in the presence of caustic soda, thereby neutralizing the caustic soda during the reaction. The charges of caustic soda and wood pulp are mixed in a plurality of mixing stages and the charge of wood pulp and oxygen are reacted in a plurality of reaction stages situated between the mixing stages. This is accomplished such that the charge of caustic soda is distributed among the reaction stages to reduce peak pH exposure of the charge of wood pulp to the caustic soda below that which would otherwise occur if the charges of wood pulp and caustic soda were mixed all at once and also, such that the average pH exposure of the charge of wood pulp to the caustic soda and therefore, wood pulp delignification is increased above that attainable if the charges of wood pulp and caustic soda were mixed all at once. The wood pulp is washed after the mixing and the reaction stages with a solvent to produce filtrate and the filtrate is introduced into the mixing stages to reduce potential wood pulp degradation produced by the increase in average pH exposure of the charge of wood pulp to the caustic soda.

In another aspect, an oxygen delignification apparatus is provided. Such apparatus is provided with a heating means for heating a charge of wood pulp. A plurality of reactor means is provided for reacting a charge of wood pulp with oxygen of an oxygen-containing gas and a plurality of mixing means is connected to the reactor means for mixing a charge of caustic soda and the charge of wood pulp with one another such that the charge of wood pulp reacts with the oxygen in the presence of caustic soda, thereby consuming the caustic soda during the reaction. The plurality of reactor means is situated between the mixing means such that the charge of caustic soda is distributed among the reaction stages to reduce peak pH exposure of the charge of wood pulp to the caustic soda below that which would otherwise occur if the charges of wood pulp and caustic soda were mixed all at once. Additionally, the average pH exposure of the charge of wood pulp to the caustic soda and therefore, the wood pulp delignification, is increased above that attainable if the charges of wood pulp and caustic soda were mixed all at once. A washing means is provided for receiving the wood pulp from the reactor means for washing the wood pulp with a solvent, thereby to produce a filtrate. The washing means is connected to the plurality of mixing means such that the filtrate is mixed with the charge of wood pulp along with the charge of caustic soda to reduce potential wood pulp degradation produced by the increase in the average pH exposure of the charge of wood pulp to the caustic soda.

As is evident, an increase in the amount of delignification can be effected by a method and apparatus in accordance with the present invention for a given charge of caustic soda. Additionally, for a given amount of delignification, the residence time of the pulp in the oxygen delignification of a pulp produced process can be reduced below prior art time periods.

In a still further aspect, a wood pulp mixer is provided for mixing a gas and wood pulp. The wood pulp mixer comprises coaxial elongated, outer and inner tubular members defining coaxial intermediate and internal passageways between the outer and inner tubular members and within the inner tubular member, respectively. The outer and inner tubular members are provided with perforations sized to retain the wood pulp between the intermediate and internal passageways while admitting the gas. A body portion houses the outer and inner tubular members and has an external passageway surrounding the outer and inner tubular members and therefore the intermediate and internal passageways. A wood pulp inlet is provided in communication with one end of the intermediate passageway for introducing the wood pulp between the intermediate and internal passageways and a wood pulp outlet is provided in communication with the opposite end of the intermediate passageway for discharging the wood pulp from the intermediate passageway. A gas inlet is provided in the body portion in communication with the external passageway for introducing the gas into the external passageway such that it passes through the perforations of the intermediate and internal passageways in an inward radial direction thereof and thereby mixes with the wood pulp and collects in the internal passageway. A gas outlet is provided in communication with the internal passageway for discharging the gas.

The wood pulp mixer as outlined above, could serve as a reaction stage in practicing a method and apparatus in accordance with the present invention. Additionally, there are other potential uses for such a wood pulp mixer, for instance, heating the wood pulp by introducing steam into the wood pulp.

BRIEF DESCRIPTION OF THE DRAWINGS

While the specification concludes with claims distinctly pointing out the subject matter that Applicants regard as their invention, it is believed that the invention will be better understood when taken in conjunction with the accompanying drawings in which:

DETAILED DESCRIPTION

Figure 1:
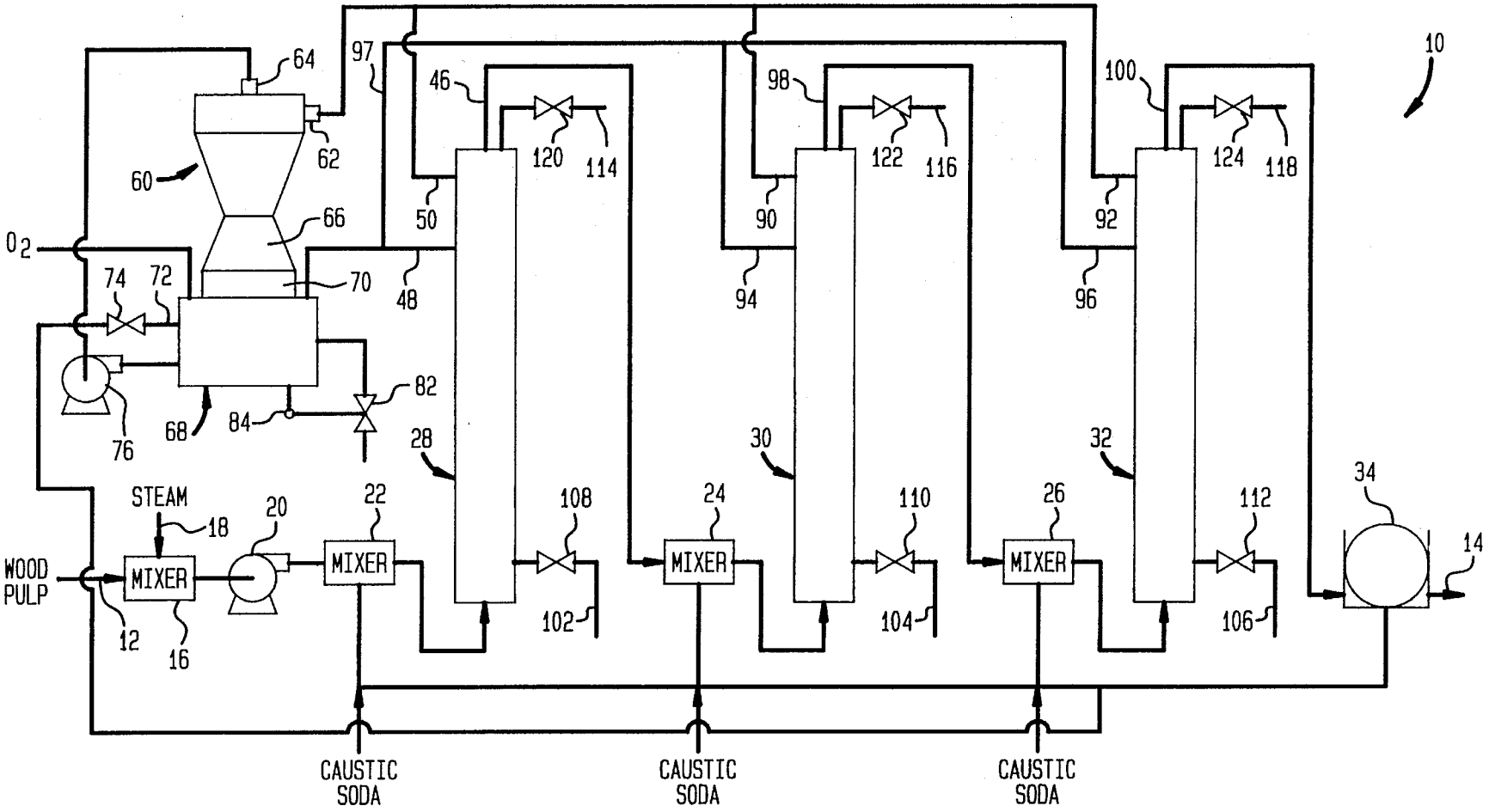
FIG. 1 is a schematic illustration of an oxygen delignification apparatus in accordance with the present invention.

With reference to FIG. 1, an apparatus 10 for carrying out an oxygen delignification method in accordance with the present invention is illustrated. Wood pulp designated by reference numeral 12 enters apparatus 10 from a prior stage in which wood chips are treated with cooking liquor to produce wood pulp 12. Delignified wood pulp 14 leaves apparatus 10 for further treatment in peroxide and/or chlorine dioxide bleaching stages.

A charge of wood pulp 12 is heated in a mixer 16 by stem 18 to a reaction temperature at which the wood pulp will react with oxygen such that lignins contained within the wood pulp will be susceptible to be washed from the wood pulp with a solvent. The thus heated wood pulp is pumped by a pump 20 through mixers 22, 24 and 26 and reactors 28, 30 and 32. Within each of the mixers 22–26, caustic soda and filtrate (which will be described in more detail hereinafter) are mixed with the wood pulp. Within each reactor 28–32, oxygen is mixed with the charge of wood pulp 12 to produce the chemical reaction with the wood pulp. In this regard, charge of wood pulp 12 is washed within a washer 34 to wash the lignins from the wood pulp. The wash water and lignins and etc. (filtrate) are then mixed with the caustic soda for mixing with the wood pulp. The caustic soda, is preferably oxidized white liquor recovered from weak black liquor. The white liquor is oxidized in a manner known in the art so that sulfides are oxidized to at least thiosulfates and sulfates.

Figure 2:
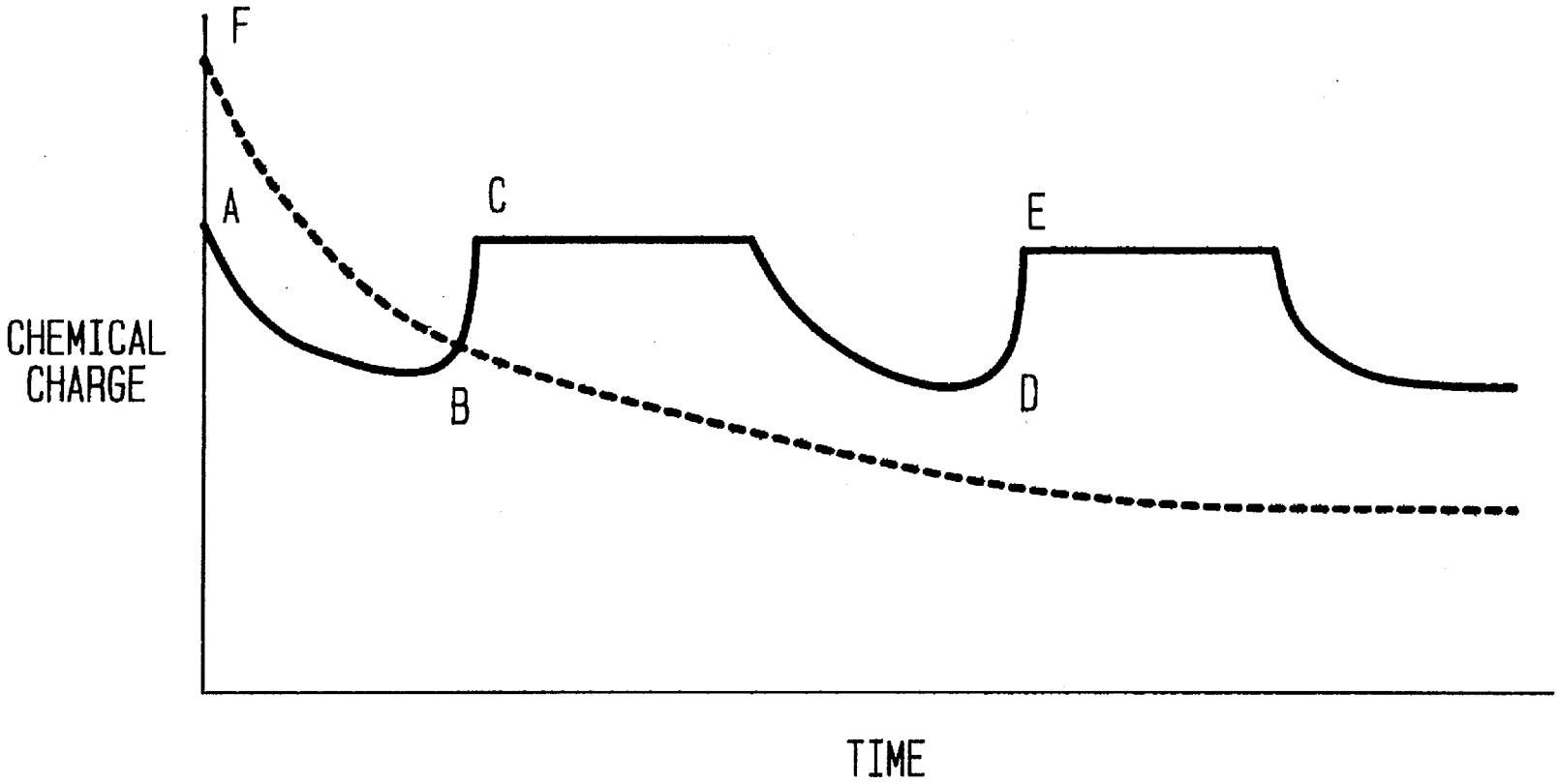
FIG. 2 is a graph of pH versus time of a charge of caustic soda and a charge of wood pulp during the reaction of wood pulp with oxygen. The solid line illustrates pH versus time in an oxygen delignification method practiced in accordance with the present invention. The dashed line illustrates pH versus time in a prior art oxygen delignification method in which the charges of wood pulp and caustic soda are mixed all at once and the charge of wood pulp is then reacted with the oxygen.

With reference to FIG. 2, charge of wood pulp 12 is treated with a charge of caustic soda within apparatus 10. From mixer 22, caustic soda and filtrate is added to the heated wood pulp. This produces a peak in pH as shown by peak A. Oxygen is then mixed with the wood pulp in reactor 28 and the reaction is allowed to proceed for approximately 15 minutes. During the reaction, the caustic soda is neutralized by acids produced by the reaction so that the pH decreases to a point referenced as B. The caustic soda thus far consumed is replenished in mixer 24 as shown by peak C. Thereafter, the caustic soda 22 is depleted in reactor 30 as evidenced by the decrease in pH to point D. The expended caustic is then restored by mixer 26 as is evidenced by peak E.

If the same charge of caustic were used to treat the same charge of wood pulp in a single prior art reaction stage, a peak pH would exist at point F. Over the span of an hour, the caustic soda would be depleted as shown by a decrease in pH in the dashed line curve. Thus, a major difference in the present invention over the prior art is that the peak pH is reduced over the prior art method and the average pH is increased over a prior art method. As stated previously, the rate of delignification is proportional to the pH. However, the rate of wood pulp degradation is also proportional to the pH because as the pH increases, the cellulose in the wood pulp begins to be attacked by the caustic soda. Hence, the present invention avoids the peak pH of point F by distributing the caustic soda over three mixers 22, 24 and 26. In addition, since caustic soda, expended in the chemical reaction, is being replenished between reaction stages, the average pH is maintained above the average pH of the prior art. The increase in average pH of the present invention favors increased delignification without subjecting the wood pulp to a high peak pH. This higher average pH in the present invention, though, also favors potential wood pulp degradation. It has been found by the inventors that the recycling of the filtrate and introducing it into mixers 22–26, retards this possible wood pulp degradation produced by the higher average pH of the present invention. Thus, when compared with the prior art, the present invention is capable of delignifying the wood pulp to a greater extent than prior art techniques. Alternatively, the present invention is capable of delignifying the wood pulp to the same extent of the prior art, except, in much less time.

The following are comparative examples between prior art oxygen delignification and oxygen delignification in accordance with the present invention. The examples consider the delignification of wood pulp of varying type. Kappa number, well known in the art is a measure of lignin content of the pulp.

Figure 3:
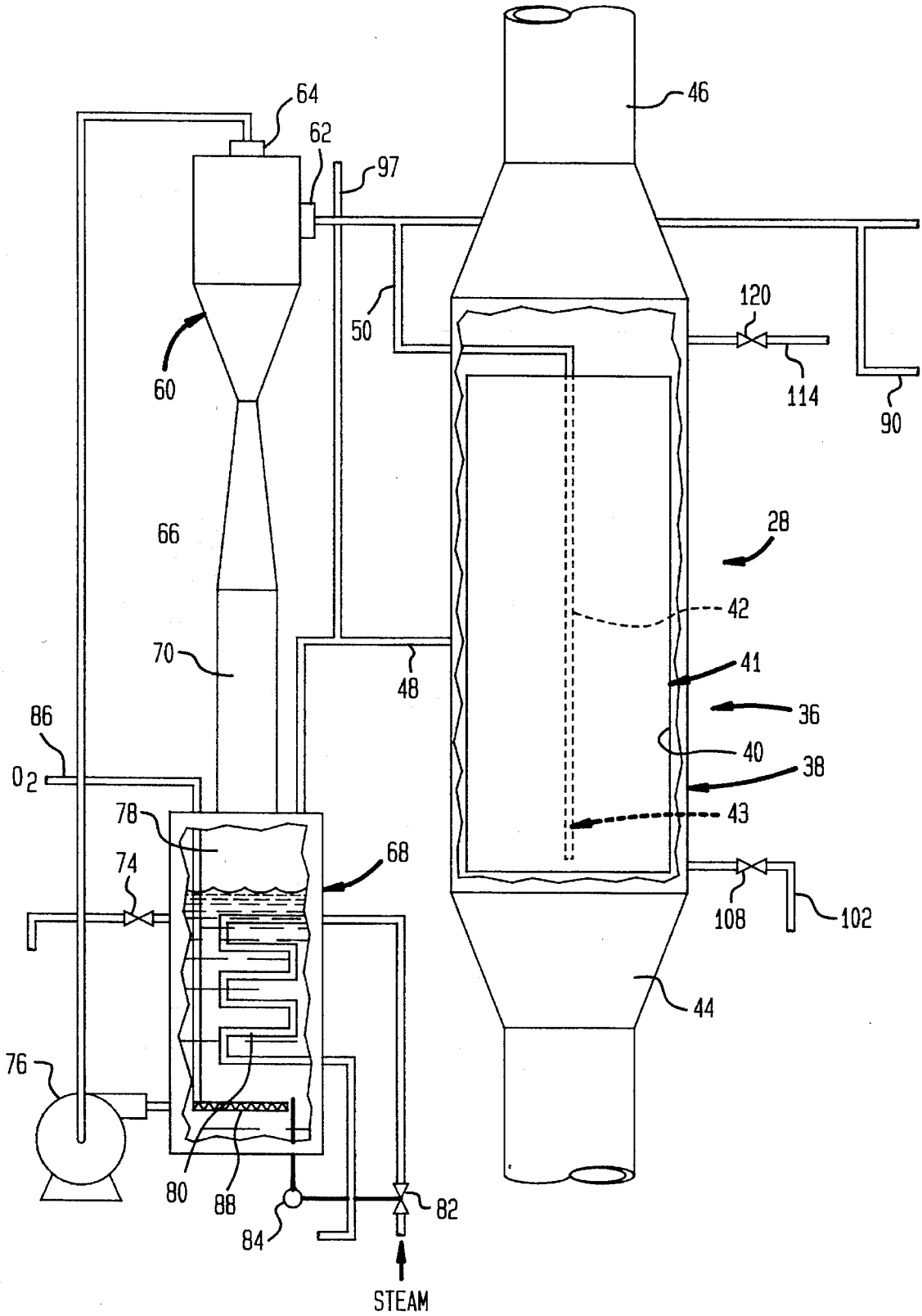
FIG. 3 is a schematic illustration of a wood pulp mixer in accordance with the present invention.

| Treatment/Pulp Type | Kappa Number | % Delignification |
|---|---|---|
| High yield pulp: | | |
| Original pulp | 78.1 | |
| Low consistency, intense mixing, 120 psig, 115° C., pH = 12, residence time = 1 hr | 23.3 | 70 |
| Apparatus of FIG. 1 3 stages, 120 psig, 115° C., pH = 12, residence time = 20 min/stage | 18.0 | 77 |
| Softwood Kraft Pulp: | | |
| Original washed Pulp | 34.1 | |
| Conventional single stage oxygen delignification 115° C., 120 psig, pH = 12, residence time = 1 hr | 18.7 | 45 |
| Apparatus of FIG. 1 3 stages, 120 psig, 115° C., pH = 12, residence time = 20 min/stage | 12.1 | 64 |

In order to produce the results set forth above, by way of example, for a Kraft pulp having a consistency of 10–14% delignification of greater than 60% and total reaction times of less than 45 minutes can be realized. In such case, the initial temperage can be anywhere from 100°–115° and the steam consumption is approximately 40 kg per ton of low pressure steam and approximately 40–180 kg per ton of high pressure steam. The caustic soda neutralization is about 24 kg per ton of pulp and the oxygen consumption is approximately 27 kg per ton of pulp. In order to protect the pulp, magnesium carbonate is added at about 0.5 kg per ton of pulp. Each of the reaction stages operates at a pressure of approximately 6670 kpa. Conventional single stage treatments of pulp under similar consumptions of steam, caustic soda, oxygen, magnesium carbonate and etc. at best fall in a range of between about 40 and about 45%.

With reference to FIG. 3, a wood pulp mixer is illustrated that is used to form reactor 28. Reactors 30 and 32 are of identical construction. Reactor 28 has a body portion 36. Body portion 36 is provided with an elongated external passageway 38. Coaxial elongated, intermediate and internal passageways 40 and 42 are provided by coaxial outer and inner tubular members 41 and 43. Outer and inert tubular members 41 and 43 are housed within body portion 28 such that external passageway 38 surrounds intermediate passageway 40 and intermediate passageway 40 surrounds internal passageway 42. The charge of wood pulp enters reactor 28 through a wood pulp inlet 44 of body portion 28 and passes between internal and external passageways 40 and 42. Wood pulp is discharged from a wood pulp outlet 46 to mixer 24. It is understood that although tubular members 41 and 43 are of cylindrical configuration for ease of fabrication, they could also be of other shapes, for instance tubes having a square, transverse cross-section and etc.

Outer and inner tubular members 41 and 43 and therefore intermediate and internal passageways 40 and 42 are provided with perforations. The perforations are sized to retain the wood pulp between intermediate and internal passageways 40 and 42 while admitting oxygen into the wood pulp. The oxygen is introduced as an oxygen-containing gas into gas inlet 48 of body portion 36. The oxygen-containing gas passes into external passageway 38 through the perforations of intermediate passageway 40 and then, into the wood pulp. The oxygen-containing gas travels in an inward radial direction of the passageways to internal passageway 42. Excess oxygen-containing gas not reacted with the wood pulp is then discharged from a gas outlet 50 of body portion 36, in communication with internal passageway 42.

It is understood that reactor 28, as described above, if appropriately sized could serve other purposes. For instance, a wood pulp mixer in accordance with the present invention could be used to mix steam with the wood pulp or in place of a static mixer to mix a gas with wood pulp.

In order to conserve oxygen in apparatus 10, oxygen-containing gas is pumped from gas outlet 50 back into gas outlet 48 for recycling back into the wood pulp. This is effectuated by means of an eductor 60. Eductor 60 has a low pressure inlet 62 and a high pressure inlet 64. High pressure motive fluid pumped through high pressure inlet 64 creates a low pressure region in eductor 60 to draw the oxygen-containing gas and entrain it with the motive fluid being pumped through inlet 64. The motive fluid and oxygen-containing gas mixture is then discharged from a high pressure outlet 66 of eductor 60 into an phase separation tank 68 which is connected to high pressure outlet 66 of eductor 60 by a conduit 70.

The motive fluid that is being pumped consists of filtrate which is introduced into phase separation tank 68 through an inlet 72 thereof. A valve 74, when open, permits replenishment of filtrate within phase separation tank 68. The filtrate is pumped by a centrifugal pump 76 back to high pressure inlet 64 of eductor 60. When pumped into phase separation tank 68, the filtrate separates from the oxygen-containing gas to form a head space 78 from which the oxygen-containing gas flows into gas inlet 48 of reactor 28. It is to be noted that in place of the recirculated filtrate, high pressure oxygen or steam could be used as the motive fluid to provide the requisite circulation.

In order to maintain the heated condition of the wood pulp, steam is pumped through a heat exchanger 80 submerged in filtrate contained within phase separation tank 68. A motor operated valve 82 is connected to a known temperature controller 84 to maintain the temperature of the filtrate in a manner well known in the art. The contact between the filtrate and the oxygen-containing gas produces direct heat exchange and the thus heated oxygen-containing gas when circulated back through the wood pulp, heats the wood pulp also by direct heat exchange. Since oxygen is also being depleted through reaction with the wood pulp and by loss of oxygen from reactor 28, oxygen is also supplied to phase separation tank through a feeder pipe 86 and a submerged diffuser 88. Diffuser 88 is a horseshoe-shaped pipe section having openings sized to permit the oxygen to escape from such openings.

Reactors 30 and 32 are of the same design as reactor 28 and have gas outlet 90 and 92 from which gas is drawn to eductor 60 and gas inlets 94 and 96 attached to a header pipe 97 through which oxygen-containing gas is recycled back to reactors 30 and 32. Wood pulp outlets 98 and 100 of reactors 30 and 32 are proved for discharging wood pulp to mixer 26 and washer 34. Reactors 28–32 are also provided with filtrate drains 102, 104, and 106 which allow accumulated filtrate to drain from reactors 28–32 when associated valves 108, 110, and 112 are opened. Additionally, reactors 28–32 are also provided with vent lines 114, 116, and 118 which allows accumulated reaction products to be vented upon the opening of vent valves 120, 122, and 124.

As would be apparent to those skilled in the art, although the invention has been described with respect to a preferred embodiment, numerous alterations, changes and omissions could be made without departing from the spirit and scope of the invention.

We claim:

1. An oxygen delignification method comprising:

heating a charge of wood pulp;

reacting the charge of wood pulp with the oxygen of an oxygen containing gas;

mixing a charge of caustic soda with the charge of wood pulp such that the charge of wood pulp reacts with the oxygen in the presence of caustic soda, thereby neutralizing the caustic soda during said reaction;

the charges of caustic soda and wood pulp being mixed in a plurality of mixing stages and the charge of wood pulp and the oxygen being reacted in a plurality of reaction stages situated between the mixing stages such that the charge of caustic soda is distributed among the reaction stages to reduce peak pH exposure of the charge of wood pulp to the caustic soda below that which would otherwise occur if the charges of wood pulp and caustic soda were mixed all at once and such that average pH exposure of the charge of wood pulp to the caustic soda and therefore, wood pulp delignification is increased above that obtainable if the charges of wood pulp and caustic soda were mixed all at once;

the reaction stages comprising reactors, each having coaxial internal and intermediate passageways an external passageway surrounding the intermediate passageway and perforations defined in the intermediate and internal passageways and sized such that the heated wood pulp is retained between the internal and intermediate perforate passageways but the oxygen-containing gas is able to pass through the said perforations;

the charge of wood pulp and oxygen being reacted within each of said reactors by introducing the charge of wood pulp between the coaxial internal and intermediate passageways of the reactor and introducing the oxygen-containing gas into the external passageway of the reactor such that it passes through said perforations of said intermediate and internal passageways in an inward radial direction thereof and thereby mixes with the charge of wood pulp and collects in the internal passageway as an excess of the oxygen containing gas;

recovering the excess of the oxygen-containing gas from the internal passageway of each of the reactors and recycling said excess of the oxygen-containing gas back to the reactors;

washing the wood pulp after the mixing and reaction stages with solvent to wash lignins from the charge of wood pulp and thereby to produce filtrate; and introducing the filtrate into the mixing stages to reduce potential wood pulp degradation produced by the increase in said average pH exposure of the charge of wood pulp to the caustic soda.

2. The oxygen delignification method of claim 1, wherein the excess of the oxygen containing gas is recycled by pumping a motive fluid through an eductor, drawing the excess of the oxygen-containing gas through the eductor and from the reactors by entraining it in the motive fluid, separating the excess of the oxygen containing gas from the motive fluid and discharging the oxygen-containing gas of the excess of the oxygen containing gas into the external passageways of the reactors.

3. The method of claim 1, wherein:

the motive fluid is the filtrate;

the filtrate is introduced into a phase separation tank and is pumped from the phase separation tank into the eductor:

the filtrate is discharged from the eductor back into the phase separation tank along with the excess of the oxygen-containing gas such that the oxygen-containing gas separates from the filtrate; and the oxygen containing gas is discharged from the phase separation tank into the external passageways of the reactors.

4. The method of claim 3, wherein there is heat leakage from the reactors and such heat leakage is compensated for by heating the filtrate within the phase separation tank such that heat is transferred from the filtrate to the excess of the oxygen containing gas.

5. The method of claim 3, wherein oxygen in the oxygen-containing gas is depleted during the mixing with the wood pulp in the reactor and additional oxygen is added by introducing the oxygen into the phase separation tank to compensate for the depletion.

* * * * *